US005845894A

United States Patent [19]

Petzl et al.

[11] Patent Number: 5,845,894

[45] Date of Patent: Dec. 8, 1998

[54] PULLEY WITH A PIVOTING FLANGE AND BUILT-IN JAMMER

[75] Inventors: Paul Petzl, Barraux; Jean-Marc Hede, Le Touvet, both of France

[73] Assignee: Zedel, Crolles, France

[21] Appl. No.: 826,404

[22] Filed: Mar. 24, 1997

[30] Foreign Application Priority Data

Apr. 25, 1996 [FR] France ..... 96 05463

[51] Int. Cl.[6] ..... B66D 3/10

[52] U.S. Cl. ..... 254/391; 254/406

[58] Field of Search ..... 254/391, 405, 254/406

[56] References Cited

U.S. PATENT DOCUMENTS

| | | | |
|---|---|---|---|
| 916,091 | 3/1909 | Batzer | 254/391 |
| 1,408,273 | 2/1922 | Davis | 254/391 |
| 2,638,184 | 5/1953 | Sturdivant | 254/391 |
| 2,754,084 | 7/1956 | Le Bus, Sr. | 254/406 |
| 3,191,910 | 6/1965 | Eitel | 254/406 |
| 5,056,760 | 10/1991 | Jorgensen | 254/406 |

FOREIGN PATENT DOCUMENTS

| | | |
|---|---|---|
| A-2 339 566 | 1/1976 | France . |
| A-2 422 587 | 4/1978 | France . |
| A 617 096 | 4/1977 | Switzerland . |
| A 2 044 414 | 2/1980 | United Kingdom . |

*Primary Examiner*—Katherine Matecki
*Attorney, Agent, or Firm*—Oliff & Berridge, PLC

[57] ABSTRACT

A pulley comprises a pair of flanges, a rotary roller mounted on a first spindle, and a second flange which oscillates on the first spindle. A jammer is incorporated inside the pulley and comprises a pivotable tumbler on a second spindle between an active locking position and an inactive unlocking position of a rope. The second spindle is tubular and extends parallel to the first spindle, and includes an internal orifice disposed to come into alignment with a hole of the second flange when the second flange reaches a position near to a closed position, so as to enable a snap-hook to be attached through an orifice of the tumbler simultaneously resulting in locking of the second flange in the closed position.

12 Claims, 12 Drawing Sheets

PULLEY WITH A PIVOTING FLANGE AND BUILT-IN JAMMER

BACKGROUND OF THE INVENTION

The invention relates to a pulley comprising a pair of first and second flanges bounding a transverse space in which there is arranged a roller mounted for rotation on a first spindle, a groove arranged in the roller to guide the rope, and means for articulation of the second flange on the first spindle enabling a relative movement of the flange between a closed position holding the rope captive in the space and an open position for fitting the rope on the roller.

Simple oscillating flange pulleys are used in a conventional manner in hoisting apparatuses, notably lifting tackle, hoisting blocks, countergear, and horizontal progression devices such as the tyrolian lift. The rotary roller is mounted free on the spindle of the pulley. If for the sake of safety measures the apparatuses have to incorporate anti-return functions, it is indispensable that a jammer be associated with the pulley, designed to block the rope when the handling force is released. The jammer is formed by a distinct apparatus joined to the pulley by a connecting snap-hook. The assembly then presents large overall dimensions and requires the rope to pass through the two apparatuses in series.

SUMMARY OF THE INVENTION

The object of the invention is to achieve a pulley with a pivoting flange and reliable anti-return which is of reduced dimensions.

The pulley according to the invention is in addition equipped with a jammer incorporated in the space and comprising a movable tumbler articulated on a second spindle between an active locking position and an inactive unlocking position of the rope, the second spindle being tubular and extending parallel to the first spindle and presenting an internal orifice disposed come into alignment with a conjugate hole of the second flange when the latter reaches a position near to the closed position, so as to enable a snap-hook to be attached through the articulation of the tumbler simultaneously resulting in locking of the second flange in the closed position.

Attaching the attachment snap-hook through the articulation spindle of the jammer reduces the size of the pulley while guaranteeing safety, since the retractable flange remains positively locked in the closed position preventing the rope from escaping.

According to one feature of the invention, the second spindle of the jammer is mounted overhanging the first flange and comprises first means for axial positioning of the tumbler and second means for engagement of the second flange in the closed position. The first means for positioning the tumbler in the space are formed by a stop arranged near to the end of the second spindle facing the second flange. The second means for engaging the second flange are formed by an annular edge protruding out from the stop and arranged coaxially with the orifice of the second spindle.

According to a preferred embodiment, the means for articulation of the second flange on the first spindle are arranged to allow opposite movements away from and towards the second spindle when closing of the second flange takes place.

The movable tumbler advantageously comprises operating means to perform locking of the tumbler in the inactive unlocking position inhibiting the action of the jammer.

Utilization of the apparatus is then reduced to a simple pulley without a jammer.

BRIEF DESCRIPTION OF THE DRAWINGS

Other advantages and features will become more clearly apparent from the following description of an embodiment of the invention, given as a non-restrictive example only, and represented in the accompanying drawings in which.

DETAILED DESCRIPTION OF THE PREFERRED EMBODIMENT

Figure 1:
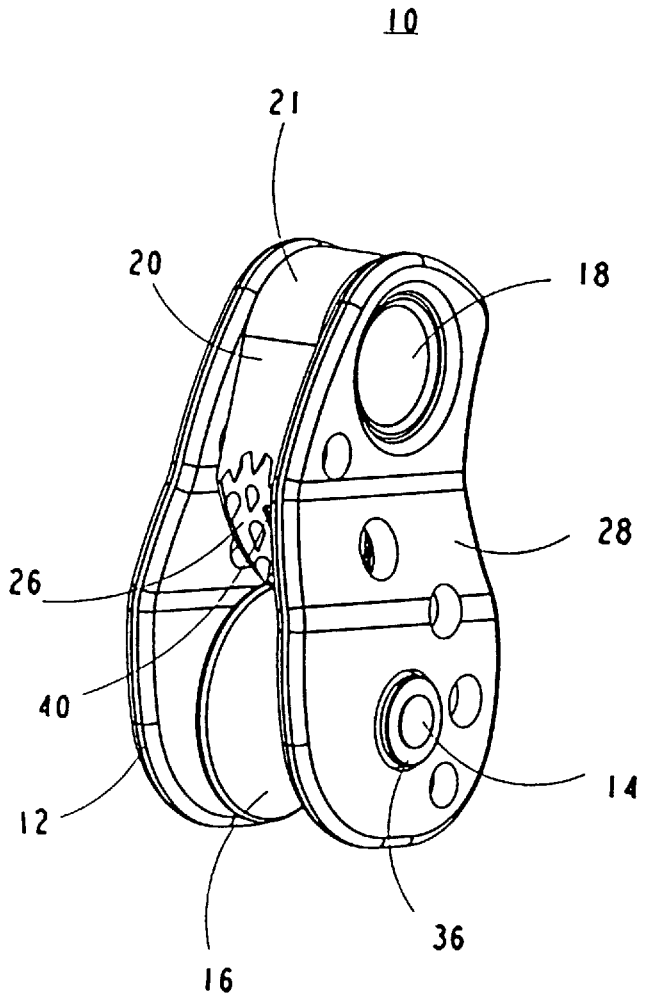
FIG. 1 is a perspective view of the pulley according to the invention, the movable flange being in the closed position.
Figure 2:
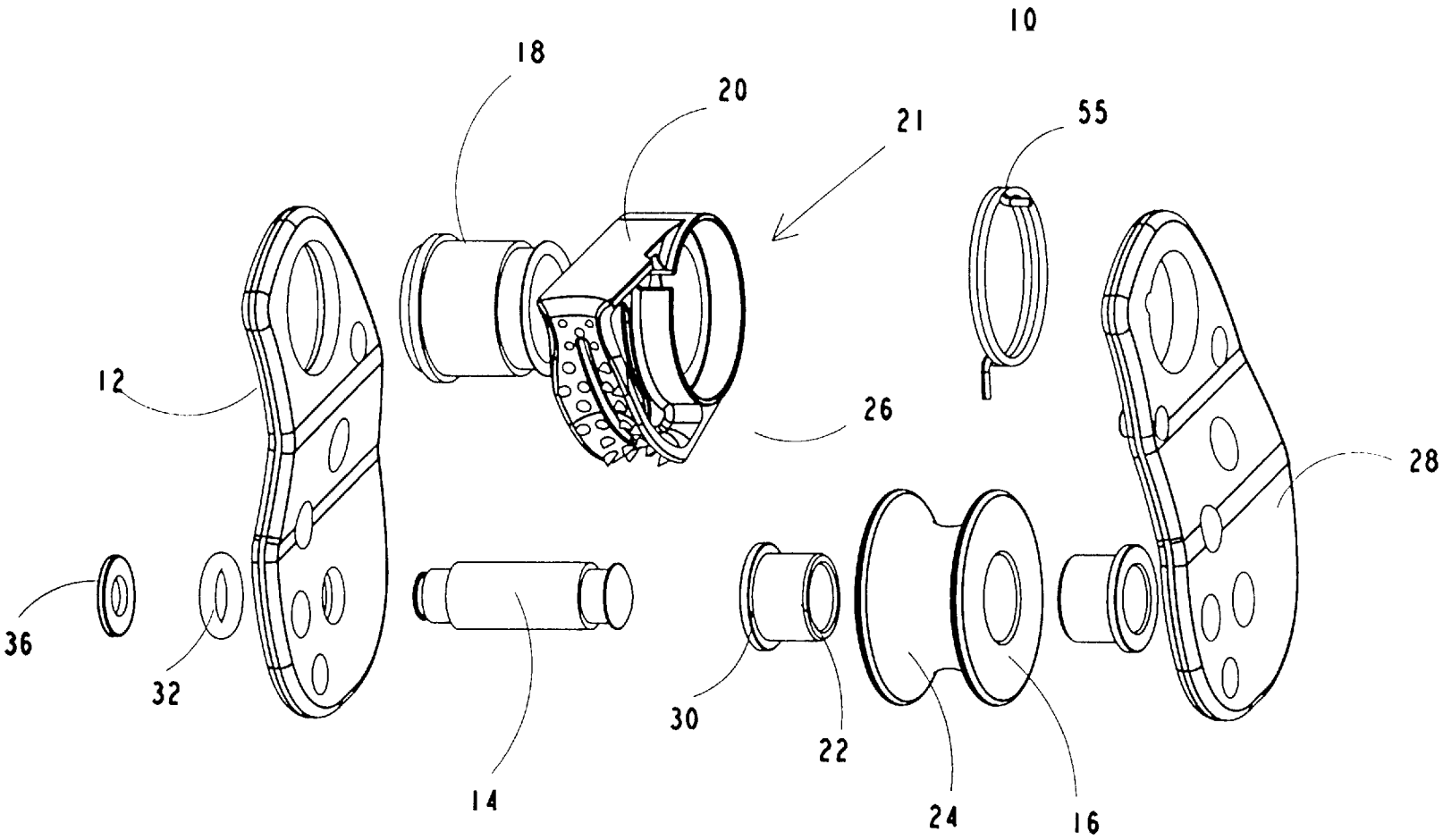
FIG. 2 shows an exploded view of the pulley of FIG. 1.

With reference to FIGS. 1 to 4, a pulley designated by the general reference 10 comprises a first fixed flange 12 acting as a support for a first spindle 14 of a rotary roller 16 and for a second spindle 18 of a locking tumbler 20 constituting a built-in jammer 21. The two spindles 14, 18 are fixed and extend parallel to one another in a direction perpendicular to the fixed flange 12. The roller 16 is mounted for free rotation on the first spindle 14 with an interposed self-oiling bearing 22, which could naturally be replaced by other parts acting as bearings.

Figure 9:
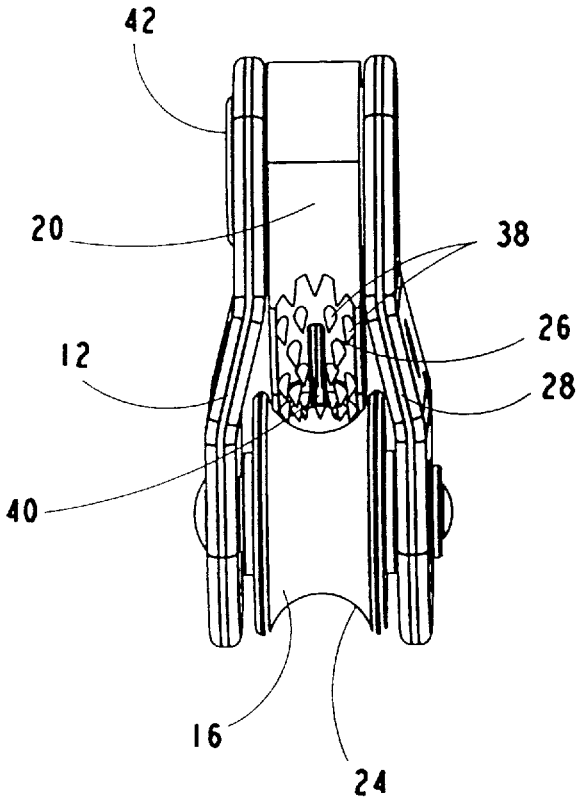

The rotary roller 16 is provided with an annular groove 24 for guiding the rope, which can be locked by a jamming surface 26 of the tumbler 20 when the latter is in the active position. A second movable flange 28 is mounted for rotation on the end of the first spindle 14 between a closed position (FIG. 1) and an open position (FIG. 9). The second flange 28 is urged against a shoulder 30 of the first spindle 14 by the action of a flexible O-ring seal 32, which is arranged in an annular groove 34 of the flange 28, and sealed off by an external washer 36 securedly affixed to the first spindle 14. The seal 32 can naturally be replaced by a simple corrugated flexible washer.

The shoulder 30 protrudes slightly out from the front face of the bearing 22 in such a way as to generate an axial clearance between the flange 28 and the bearing 22 so as not to hinder the rotational movement of the movable flange 28 with respect to the roller 16. The flanges 12, 28 and roller 26 are made of aluminium, whereas the tumbler 20 is made of steel. The jamming surface 26 comprises a plurality of retaining barbs 38 designed to jam the rope in the active position, and a central slit 40 for evacuating mud or ice coming from the rope. The roller 16 and jammer 21 are both arranged in a transverse space 41 arranged between the two flanges 12, 28.

The second spindle 18 of the tumbler 20 is tubular and is mounted overhanging the first spindle 12. One of the ends 42 is crimped onto the first flange 12 whereas the opposite end 44 comprises a stop 46 for axial positioning of the body of the tumbler 20 and an engagement edge 48 of the second flange 28 when the latter is moved to the closed position. The internal orifice 50 of the second spindle 18 is of circular cross-section and enables an attachment snap-hook to be passed through.

Fitting of the second flange 28 onto the annular engagement edge 48 is possible due to a circular hole 52 provided at the free end of the movable second flange 28. The internal diameter of the hole is slightly greater than the external diameter of the engagement edge 48.

The presence of the seal 32 in the groove 34 allows a certain braking by friction of the rotational movement of the second flange 28 around the first spindle 14 and in addition allows a slight alternate rocking movement of the second flange 28 near to the closed position. The rocking movement is centered on the first spindle 14 and is made possible by the deformation of the seal 32 (FIG. 3) alternately enabling a separation movement in the direction of the arrow F1 for alignment of the hole 52 with the orifice 50, and a closing together movement in the opposite direction indicated by the arrow F2 for insertion of the hole 52 on the engagement edge 48 of the second spindle 18.

The body of the locking tumbler 20 is provided with a padlocking opening 54 enabling a snap-hook to be passed through for locking the tumbler 20 in the inactive position. After the snap-hook has been removed from the opening 54, a return spring 55 urges the tumbler 20 to the active locking position, the spring being formed by a torsion spring inserted in a notch of the body of the tumbler 20.

If there is no rope inside the space 41, the tumbler 20 presses against the stop formed by the roller 16. In the separated position, a rib of the tumbler 20 comes up against a stop spigot of the flange 28.

Figure 5:
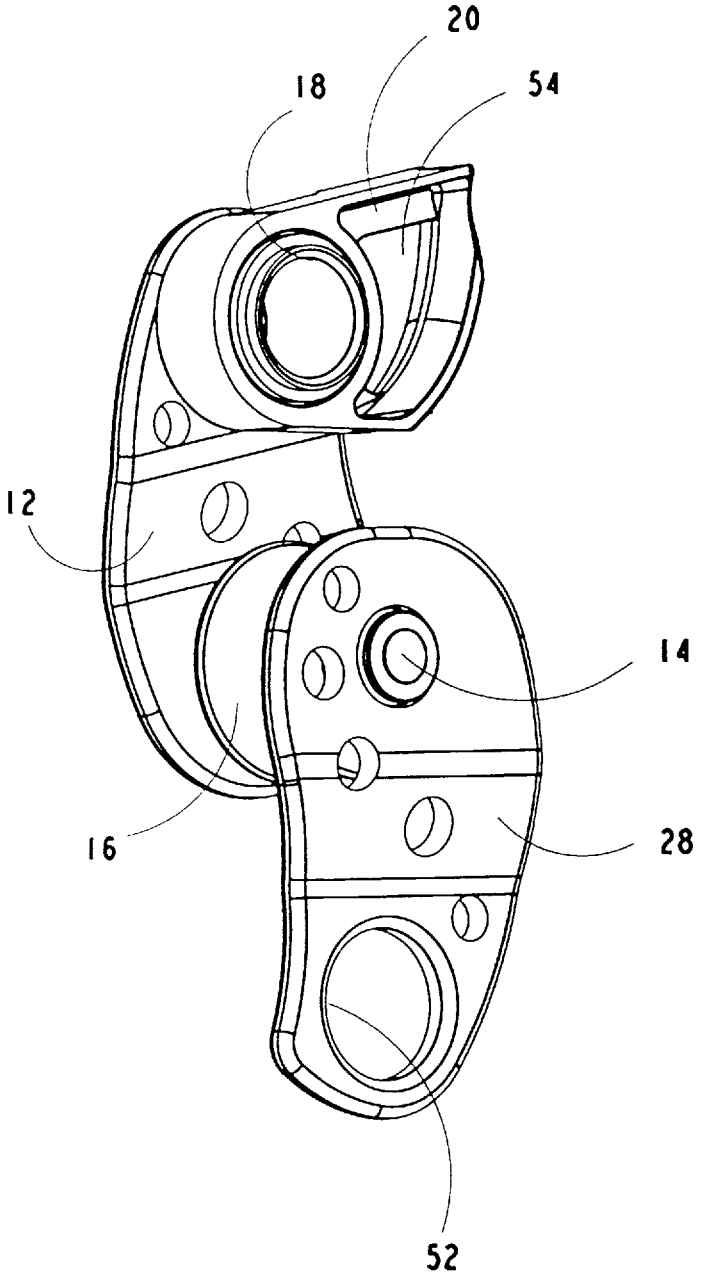
FIG. 5 shows the pulley of FIG. 4, after the tumbler of the jammer has been moved to the inactive unlocking position for the rope to be inserted in the groove of the roller.

The rope 56 is inserted in the pulley 10 after the movable flange 28 has been previously lowered to the open position (FIG. 4) followed by movement of the tumbler 20 to the inactive position (FIG. 5) enabling the rope 56 to be inserted in the gorge 24 of the roller 16.

Figure 6:
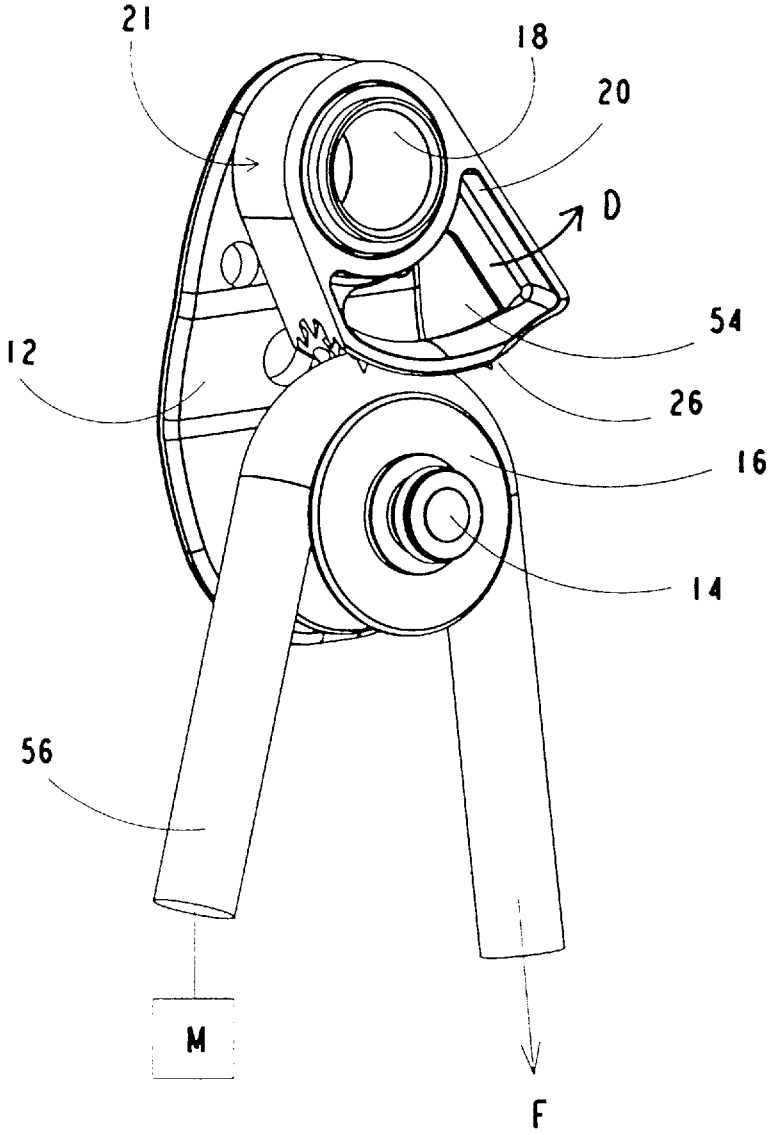
FIG. 6 illustrates the pulley of FIG. 1, after the rope has been inserted, the movable flange not being represented.

FIG. 6 shows a first application of an anti-return guide pulley, the movable flange 28 not being represented for the sake of clarity of the drawing. The rope 56 is fitted in place on the roller 16, and the jamming surface 26 is in contact with the rope 56 following the return action of the spring 55. In the presence of a sufficient force F applied to the right-hand strand of the rope 56, raising of a weight M by the left-hand strand is made possible due to driving of the tumbler in the unlocking direction indicated by the arrow D. Unlocking by counterclockwise pivoting of the tumbler 20 is achieved by the friction exerted by the rope 56 on the barbs of the surface 26 when the roller 16 rotates clockwise. In case of the force F being released, the weight M does not drop due to the counteraction of the anti-return jammer 21, whose tumbler 20 automatically comes back in the opposite direction to the active position in which the jamming surface 26 exerts a high pressure on the rope 56.

Figure 7:
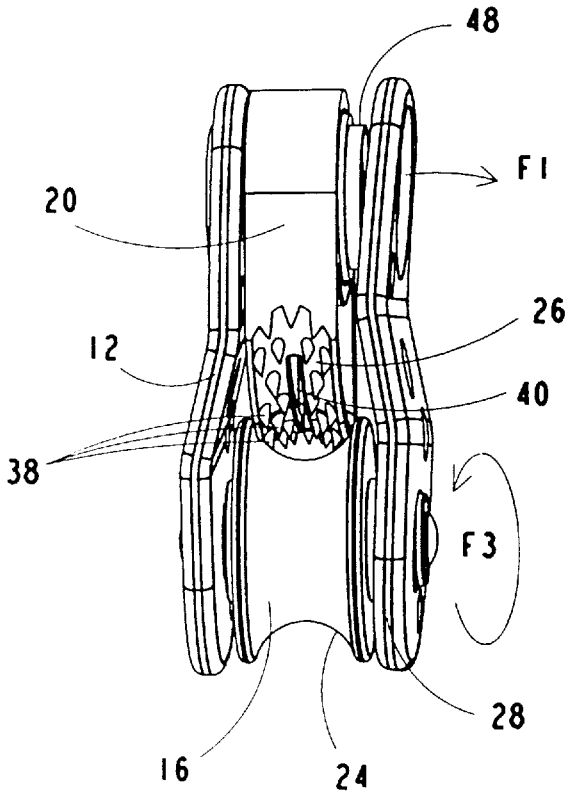
FIGS. 7 to 9 show side views of the pulley of FIG. 1 in the course of the different phases of closing of the movable flange.
Figure 8:
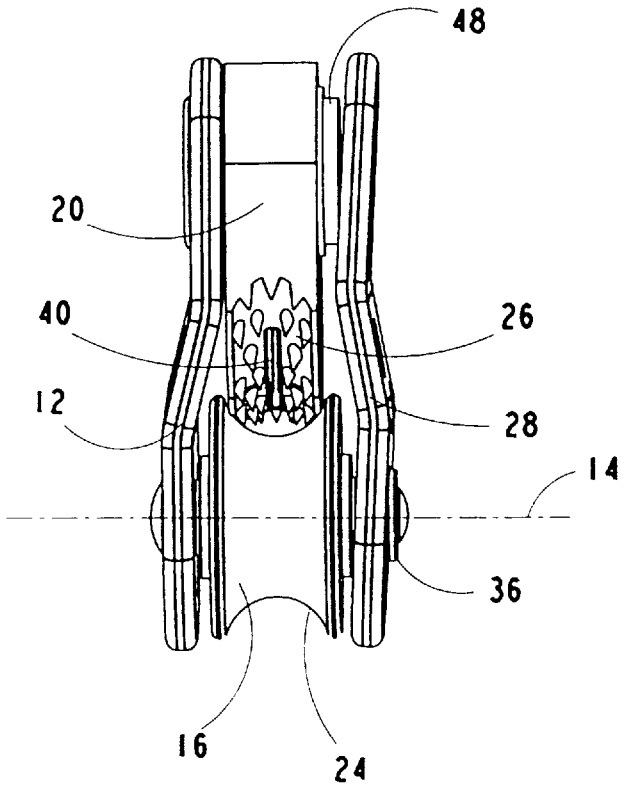

Closing of the movable second flange 28 is illustrated in FIGS. 7 to 9, the rope 56 not being represented. In FIG. 7, the movable flange 28 is first turned in the direction F3 around the first spindle 14 followed at the end of closing travel by a slight separation movement in the direction F1 to allow passage over the engagement edge 48 of the hollow second spindle 18.

Figure 3:
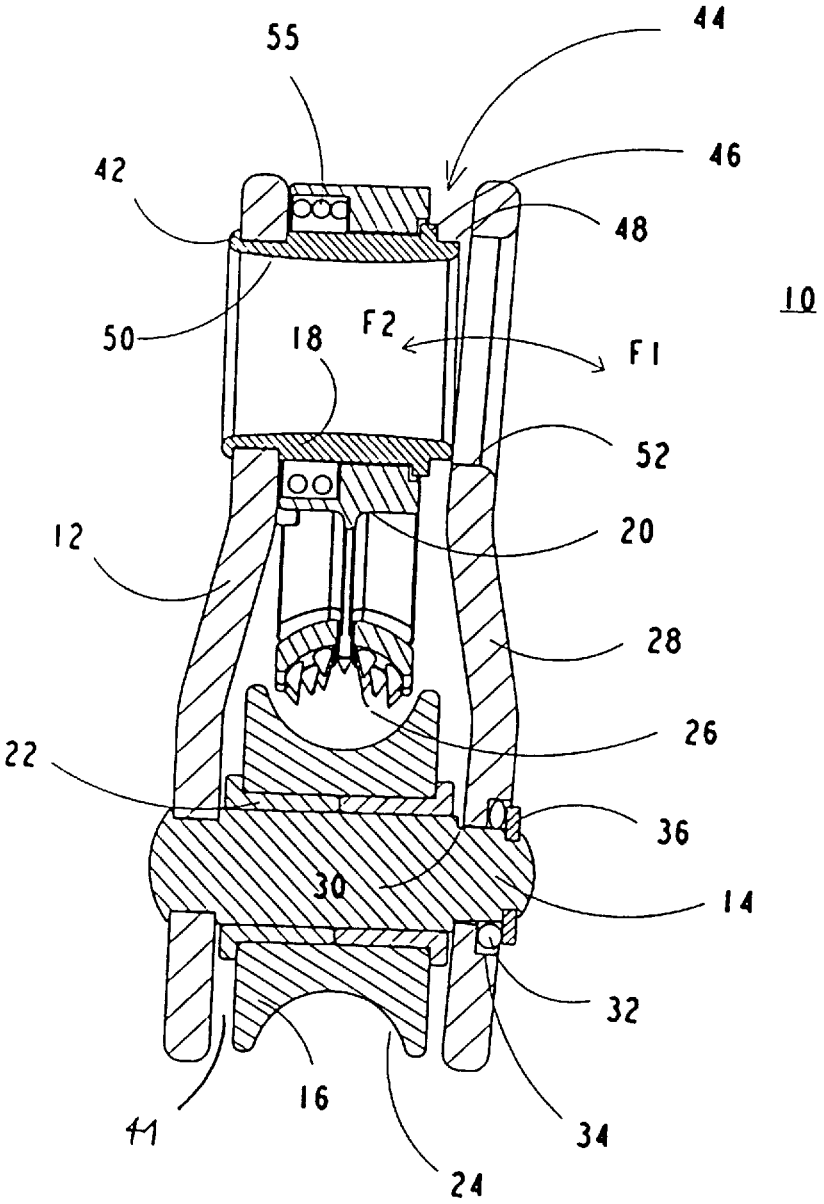
FIG. 3 represents a vertical sectional view of the pulley of FIG. 1.
Figure 4:
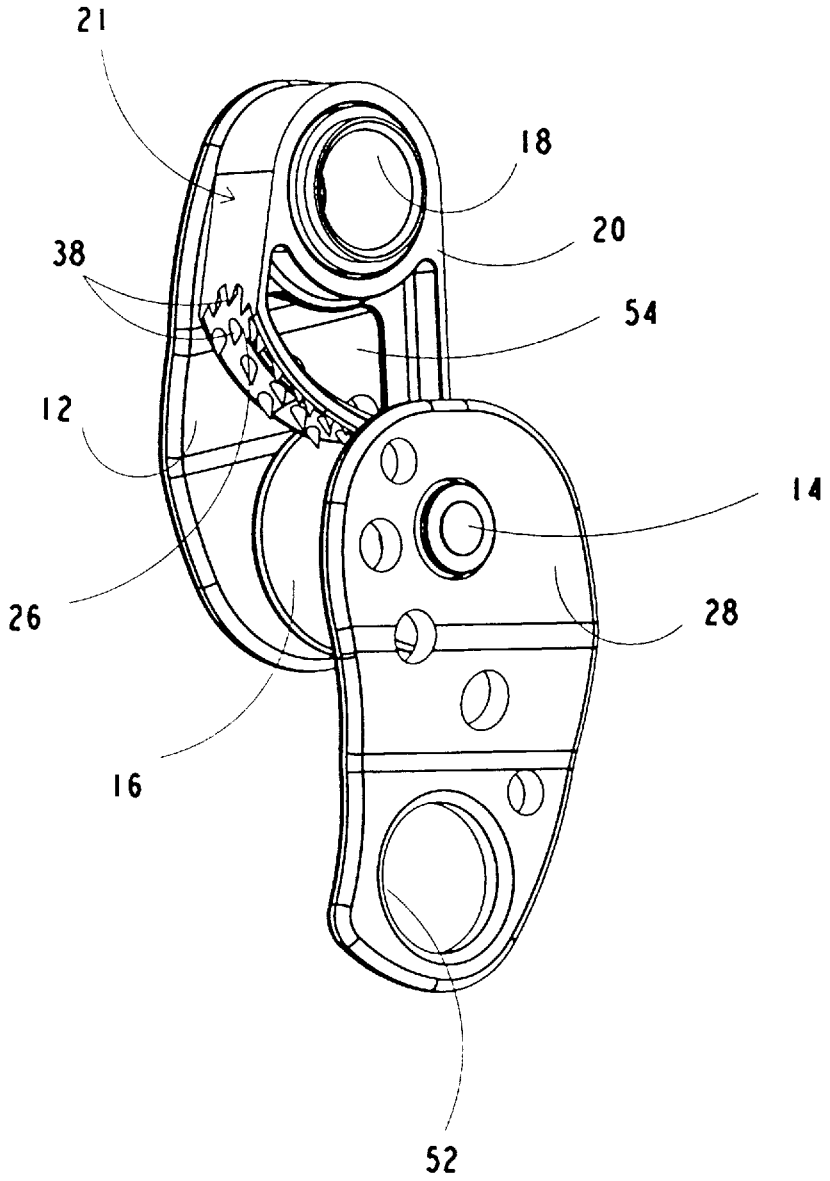
FIG. 4 is a view of the pulley according to FIG. 1, after the movable flange has been rocked to the open position.

FIG. 8 corresponds to FIG. 3 illustrating the next stage of reclosing of the movable flange 28, in which the hole 52 is in alignment with the orifice 50 and ready to be engaged on the edge 48 of the second flange 18.

FIG. 9 shows the final phase of closing of the second flange 28, which is engaged on the articulation of the tumbler 20 of the jammer 21. The hole 52 of the second flange 28 acts as a bearing for the edge 48 of the second spindle 18, which prevents overhanging operation of the tumbler 20.

Figure 10:
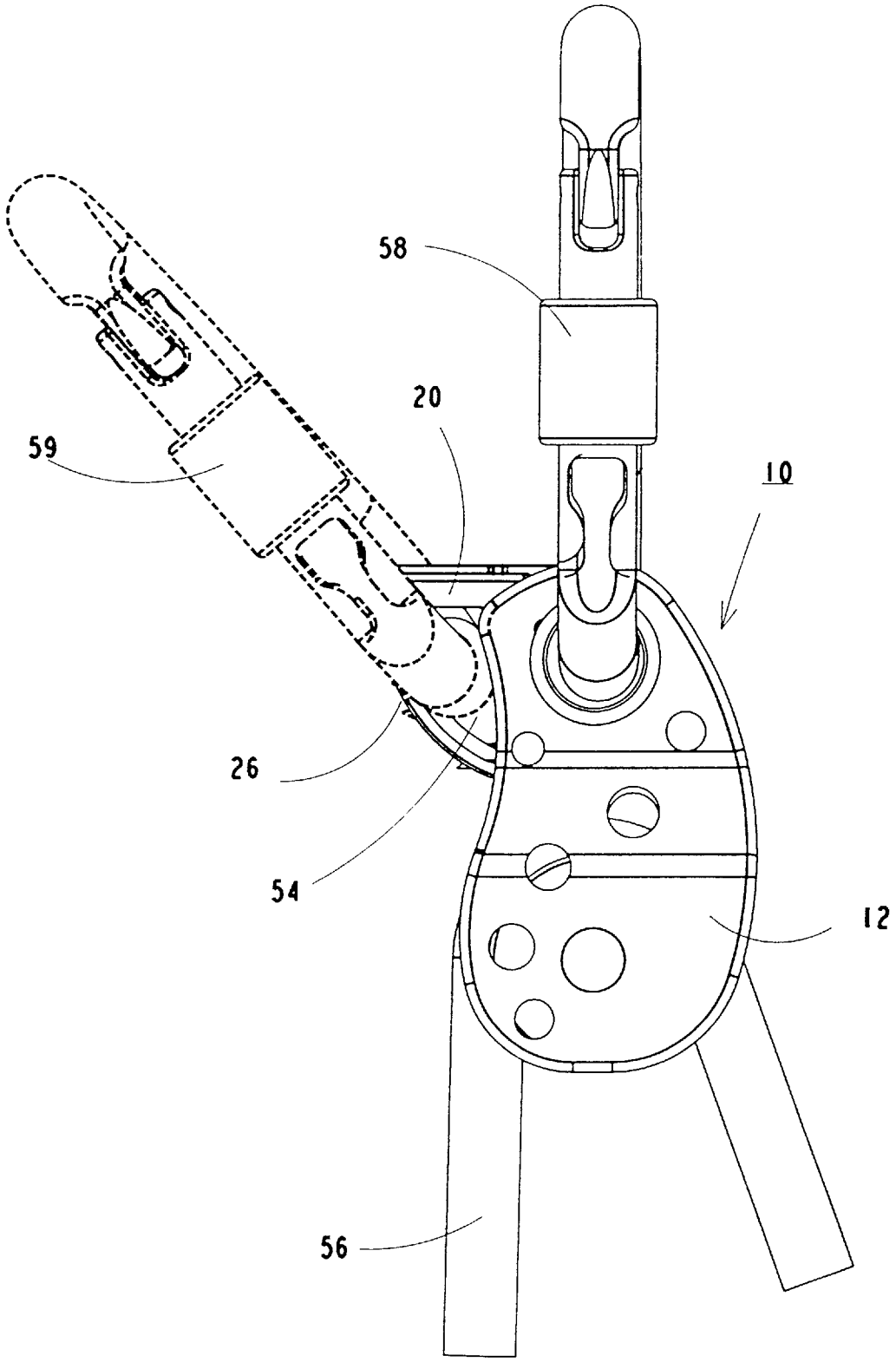
FIG. 10 represents two possibilities of use of the pulley, either as an antireturn guide pulley, or as a simple pulley without a jammer following padlocking of the tumbler in the inactive unlocking position by means of an additional snap-hook (represented by a broken line)

FIG. 10 represents two modes of use of the pulley 10 depending on whether the tumbler 20 is free or blocked. Passing the attachment snap-hook 58 through the hollow second spindle 18 and the hole 52 of the second flange 28 enables use as an anti-return guide pulley. In this case, the tumbler 20 is free and is able to block the rope. Attaching the snap-hook 58 through the articulation of the tumbler 20 of the jammer 21 enables the size of the body of the pulley 10 to be reduced. The second flange 28 remains locked in the closed position following the passage of the snap-hook 58 in the hollow articulation spindle 18 of the tumbler 20. If an additional snap-hook 59 is inserted in the padlocking opening 54 of the tumbler 20 when the latter is in the separated position, the assembly then behaves like a normal pulley without a jammer. The tumbler 20 remains locked in the open position, which keeps the jamming surface 28 permanently away from the rope 56.

Figure 11:
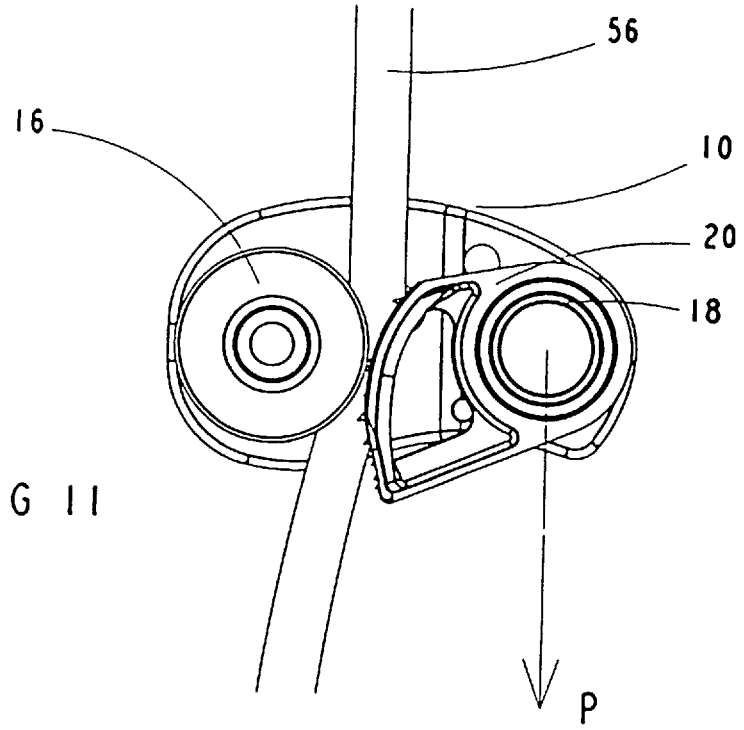
FIG. 11 shows another application of the pulley as an additional jammer for ascending along a rope.

FIG. 11 shows another application of the pulley 10 as an additional jammer for ascending along a rope 56. The weight P is applied to the spindle 18 of the tumbler 20 and the rope 56 passes between the roller 16 and the jamming surface 26.

Figure 12:
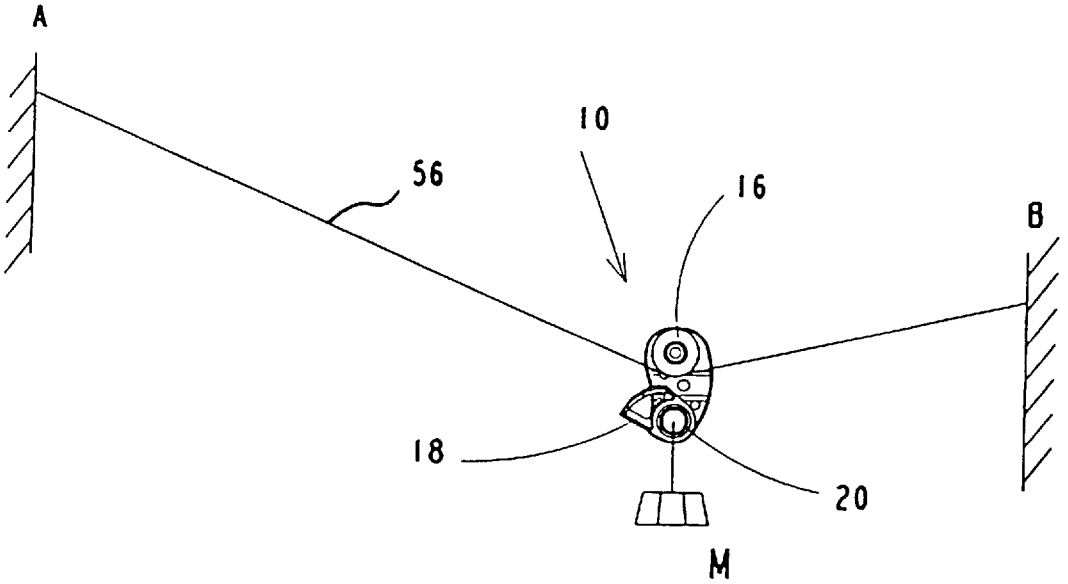
FIG. 12 illustrates another application of the pulley in a unidirectional tyrolian lift.

FIG. 12 represents a unidirectional tyrolian application, wherein the pulley 10 moves along a rope 56 between a departure point A and an arrival point B situated at a lower level. The rope 56 passes under the roller 16 and the weight M is hooked onto the second spindle 18 of the tumbler 20. Other applications are possible, notably for hauling, rescue operations, and progressing along a rope.

Figure 13:
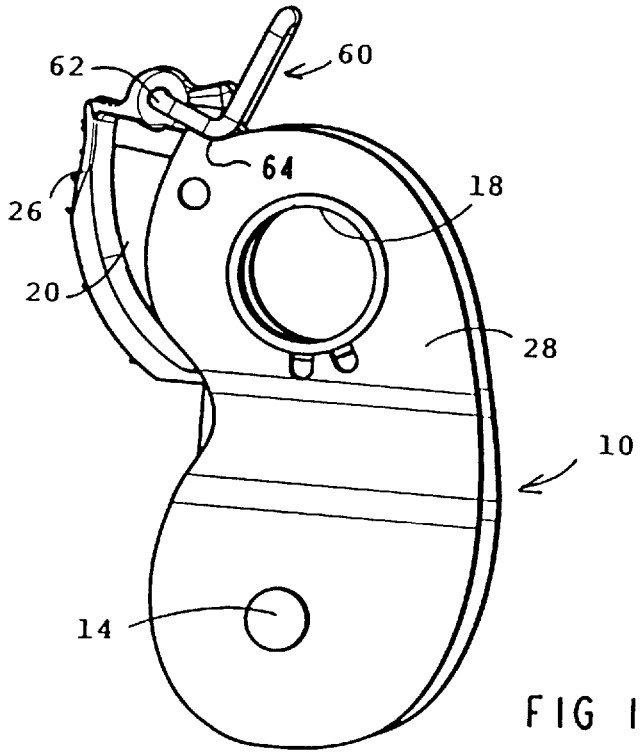
FIG. 13 shows an alternative embodiment of the pulley equipped with an operating lever designed to position the tumbler in an inactive open position.
Figure 14:
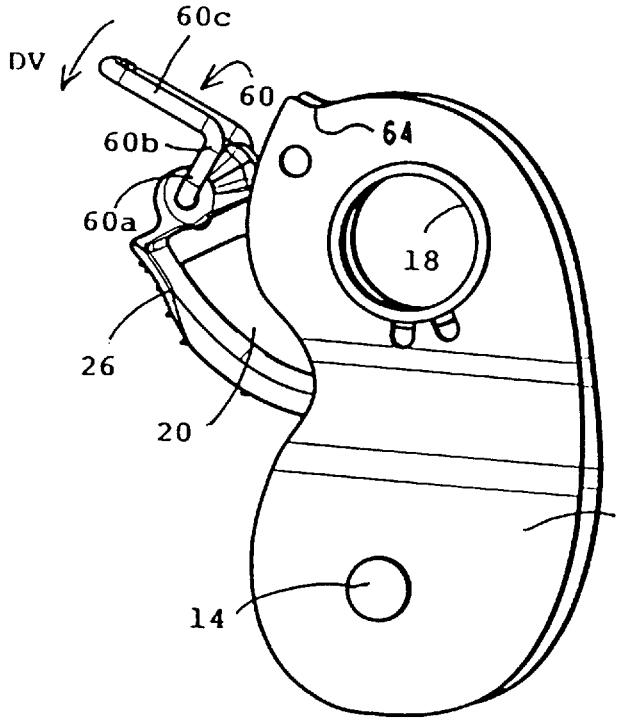
FIG. 14 is an identical view to FIG. 13 when unlocking of the lever takes place moving the tumbler to the active position.

In FIGS. 13 and 14, the locking tumbler 20 is provided with an operating lever 60 articulated on a spindle 62 of the tumbler 20 and having an angled shape. The lever 60 comprises a first arm **60*a* situated between the spindle 62 and the intermediate zone 60*b* folded at right angles, and a second arm 60*c* acting as gripping part. The first arm 60*a* is designed to cooperate with a bearing surface 64 provided at the top part of the flanges 12, 28 to position the tumbler 20 in an open position (FIG. 13) in which the jamming surface 28 does not come into contact with the rope 56**.

The second arm **60*c* simply has to be rocked in the unlocking direction DV (FIG. 14) to automatically move the tumbler 20 to the active position due to the action of the return spring 55**.

We claim:

1. A pulley comprising:

a) a first flange;

b) a second flange including a hole, the first and second flanges bounding a space therebetween;

c) a first spindle mounted to the first and the second flanges;

d) a roller to guide a rope rotatably mounted on the first spindle;

e) means for pivoting the second flange on the first spindle between an open position for fitting the rope on the roller and a closed position holding the rope captive in the space;

f) a tubular second spindle mounted to the first flange and extending parallel to the first spindle, the second spindle including an internal orifice; and g) a jammer disposed in the space, the jammer including a tumbler which is pivotable on the second spindle between a locking position in which the tumbler contacts the rope and an unlocking position in which the tumbler does not contact the rope, the tumbler including an opening, the internal orifice of the second spindle being aligned with the hole of the second flange when the second flange is positioned between the open position and the closed position, thereby enabling a snap-hook to be attached through the hole and the internal orifice so as to simultaneously lock the second flange in the closed position.

2. The pulley according to claim 1, wherein the second spindle is mounted above the first spindle, and the second spindle comprises an axis and means for positioning the tumbler along the axis and means for engagement of the second flange in the closed position.

3. The pulley according to claim 2, wherein the means for positioning the tumbler along the axis comprises a stop disposed near to an end of the second spindle that faces the second flange.

4. The pulley according to claim 3, wherein the means for engagement of the second flange comprises an annular edge which protrudes outward from the stop and is coaxial with the internal orifice of the second spindle.

5. The pulley according to claim 2, wherein the means for pivoting the second flange on the first spindle is disposed to enable pivoting of the second flange away from and towards the second spindle during movement of the second flange in the direction toward the closed position.

6. The pulley according to claim 5, further comprising a seal and a washer fitted on the first spindle and disposed in an annular groove of the second flange, a shoulder on the first spindle, the seal cooperating with the washer to urge the second flange against the shoulder, while enabling pivotal movement of the second flange at a position of the second flange near to the closed position when the seal is deformed.

7. The pulley according to claim 6, further comprising bearings on the first spindle, and the roller being rotatably mounted on the bearings.

8. The pulley according to claim 1, wherein the tumbler comprises an operating lever for locking the tumbler in the unlocking position.

9. The pulley according to claim 8, further comprising a return spring which cooperates with the tumbler to urge the jammer to the locking position when the operating lever is actuated.

10. The pulley according to claim 8, wherein the operating lever is pivotably attached to the tumbler, the first and second flanges including bearing surfaces, and the operating lever is shaped to cooperate with the bearing surfaces when the tumbler is in the unlocking position.

11. A pulley comprising:

a) a first flange;

b) a second flange including a hole, the first and second flanges bounding a space therebetween;

c) a first spindle mounted to the first and the second flanges, the second flange being pivotal on the first spindle between an open position and a closed position;

d) a roller to guide a rope rotatably mounted on the first spindle;

e) a tubular second spindle mounted to the first flange at a position spaced from the first spindle, the second spindle including an internal orifice; and f) a tumbler pivotal on the second spindle to selectively engage the rope, the internal orifice of the second spindle being aligned with the hole of the second flange when the second flange is positioned between the open position and the closed position, thereby enabling a snap-hook to be attached through the hole and the internal orifice so as to lock the second flange in the closed position.

12. A pulley comprising:

a) a first flange;

b) a second flange horizontally spaced from the first flange, the second flange including a hole;

c) a roller disposed between the first and second flanges to guide a rope;

d) a spindle mounted to the first flange and spaced vertically from the roller, the spindle including an internal orifice; and e) a tumbler pivotal on the spindle to selectively engage the rope, the second flange being pivotal such that the hole of the second flange is aligned with the internal orifice of the spindle, thereby enabling a snap-hook to be attached through the hole and the internal orifice so as to lock the second flange in a closed position.

* * * * *